US009359895B2

(12) United States Patent
Fader et al.

(10) Patent No.: US 9,359,895 B2
(45) Date of Patent: Jun. 7, 2016

(54) CUTTING BIT RETAINING ASSEMBLY

(71) Applicant: SANDVIK INTELLECTUAL PROPERTY AB, Sandviken (SE)

(72) Inventors: Joe Fader, Steiermark (AT); Hannes Voitic, Weiβkirchen (AT)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 14/477,699

(22) Filed: Sep. 4, 2014

(65) Prior Publication Data

US 2015/0069816 A1 Mar. 12, 2015

(30) Foreign Application Priority Data

Sep. 6, 2013 (EP) ..... 13183341

(51) Int. Cl.

| | |
|---|---|
| ***E21C 35/19*** | (2006.01) |
| ***E21C 35/197*** | (2006.01) |
| ***E21C 25/00*** | (2006.01) |
| ***E21C 35/00*** | (2006.01) |

(52) U.S. Cl.

CPC ..... *E21C 35/197* (2013.01); *E21C 25/00* (2013.01); *E21C 35/00* (2013.01); *E21C 2035/191* (2013.01)

(58) Field of Classification Search

CPC ..... E21C 2035/191

USPC ..... 411/522, 523, 970; 299/102, 103, 107, 299/109; D8/395

See application file for complete search history.

(56) References Cited

U.S. PATENT DOCUMENTS

| | | | | | |
|---|---|---|---|---|---|
| 2,710,180 | A | * | 6/1955 | Graham | E21C 25/62 125/40 |
| 3,767,266 | A | | 10/1973 | Krekeler | |
| 3,820,848 | A | | 6/1974 | Kniff | |
| 3,957,307 | A | * | 5/1976 | Varda | 299/106 |
| 4,247,150 | A | | 1/1981 | Wrulich et al. | |
| 4,623,050 | A | * | 11/1986 | Copp | 188/340 |
| 4,650,254 | A | * | 3/1987 | Wechner | E21C 35/193 299/102 |
| 4,678,238 | A | * | 7/1987 | Emmerich | 299/81.1 |
| 6,070,945 | A | * | 6/2000 | Ritchey et al. | 299/107 |
| 6,428,110 | B1 | | 8/2002 | Ritchey et al. | |

FOREIGN PATENT DOCUMENTS

| | | | |
|---|---|---|---|
| GB | 2109438 | A | 6/1983 |
| WO | 2009139692 | A1 | 11/2009 |

* cited by examiner

*Primary Examiner* — Sunil Singh
(74) *Attorney, Agent, or Firm* — Corinne R. Gorski

(57) ABSTRACT

A cutting bit retaining assembly for mounting a cutting bit at a cutting machine includes a holder body having a through bore to receive a bit shaft. A retainer acts against the holder body and bit shaft and includes a first and second abutment member that provides a reliable and constant locking force between the body and the shaft.

13 Claims, 3 Drawing Sheets

FIG. 3
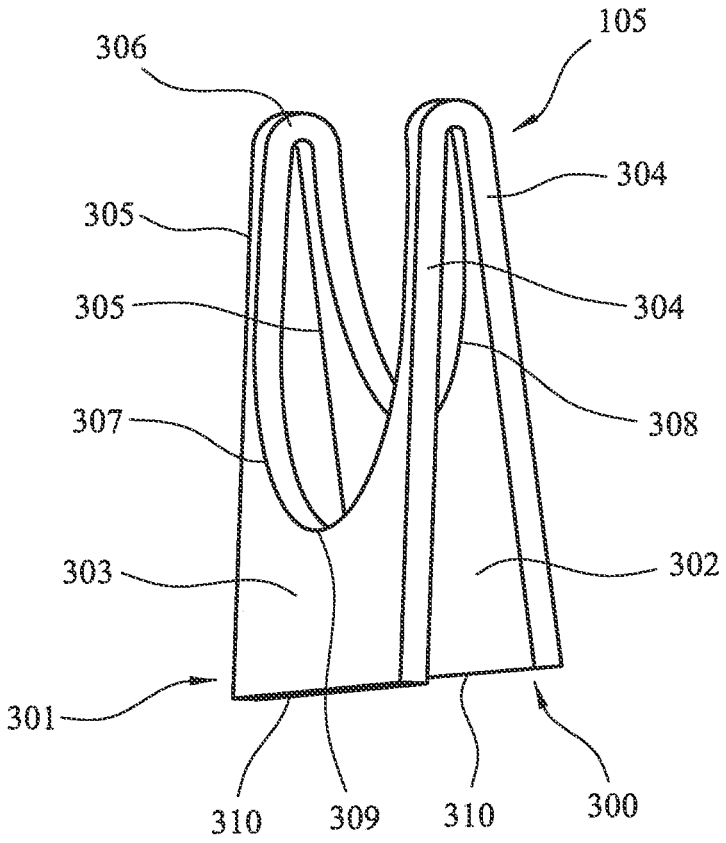
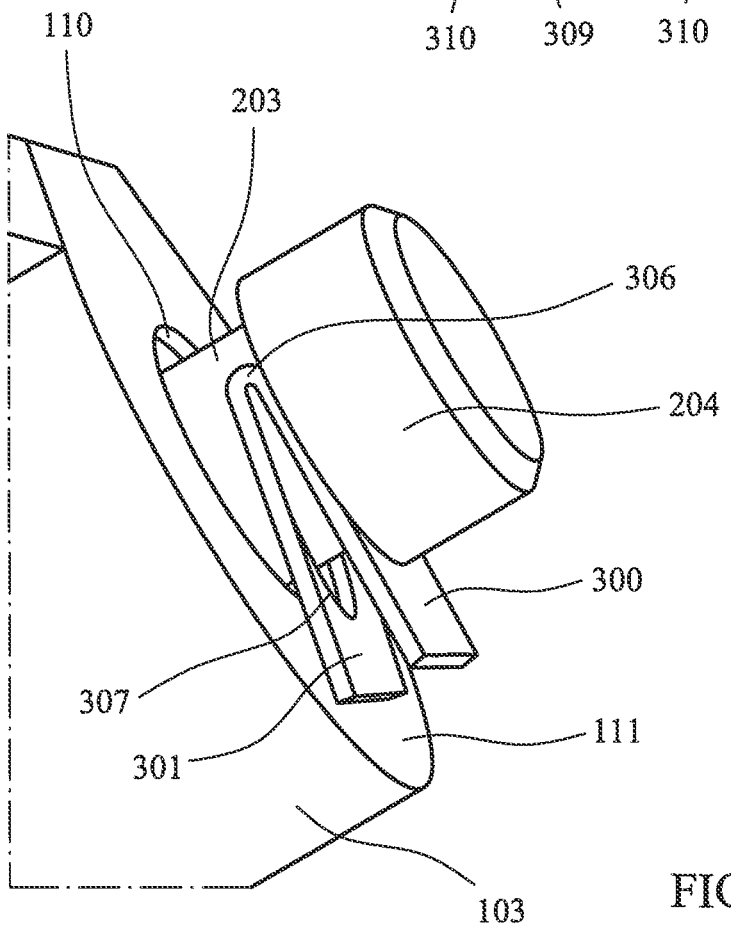
FIG. 4

CUTTING BIT RETAINING ASSEMBLY

RELATED APPLICATION DATA

This application claims priority under 35 U.S.C. §119 to EP Patent Application No. 13183341.0, filed on Sep. 6, 2013, which the entirety thereof is incorporated herein by reference.

TECHNICAL FIELD

The present disclosure relates to a cutting bit retaining assembly for mounting a cutting bit at a cutting machine, and in particular, although not exclusively, to a holder for a cutting bit that provides a secure and releasable attachment of the cutting bit at the cutting machine.

BACKGROUND

Rock cutting and excavation machines have been developed for various specific applications including mining, trenching, tunneling, foundation drilling, road milling, etc. Typically, a drive body in the form of a rotatable drum or drill head comprises a plurality of replaceable cutting bits that provide the points of contact for the material or mineral face.

For example, a mobile mining machine includes a rotatable cutting head with the cutting bits provided on rotating drums. As the bits contact the surface of the seam they occasionally break and inevitably wear resulting in decreased cutting inefficiency and a need for replacement. It is therefore desirable to mount the cutting bits at the cutting head (or drive body) via releasable mounting assemblies that enable the bits to be replaced conveniently and quickly during servicing and repair.

Cutting bit (alternatively termed 'cutting pick' or 'tool pick') mountings are described in U.S. Pat. No. 3,342,531; U.S. Pat. No. 3,627,381; U.S. Pat. No. 4,343,516; WO 2010/027315; US 2011/0278908 and EP 2514918.

Cutting bits have been developed that may be considered to fall in at least two general categories. A first general type comprises a nose portion attached at one end of an elongate shaft whilst a second type comprises a bit head having an inner cavity that fits onto an end of an 'adaptor' that forms an elongate shank. In both cases, the shaft or shank is received within and held at the mount body by a form retainer.

However, conventional methods of mounting the cutting pick (of the types mentioned) to the mount or drive body involve press-fit, threaded nut or locking washer arrangements typically provided at a rearward end of the cutting bit shaft or adaptor. These conventional means for retaining the shaft or adaptor at the mount body suffer from a number of disadvantages. In particular, press-fit sleeves are typically cumbersome to install and remove and typically require additional specialised tools for quick removal. A threaded nut or general screw thread arrangement is disadvantageous within a dusty environment where the threads become blocked quickly due to the dirty environment in which the cutter is operating. Additionally, due to the machine and cutting vibrations during operation, nut and screw thread fastenings require constant retightening to ensure the cutting bits do not become dislodged. Conventional locking washer arrangements are similarly disadvantageous in that during use, the washers wear resulting in the undesirable movement of the shaft or adaptor at the holder body which also acts to reduce cutting efficiency and damage to the pick holder. Accordingly, what is required is a cutting bit retaining assembly that addresses these problems.

SUMMARY

An objective of the present disclosure is to provide a cutting bit retaining assembly for mounting a cutting bit at a cutting machine that provides a secure means of attachment of the bit and that allows convenient and quick interchange of worn or damaged bits within a dark and dust laden environment such as a mine.

It is a further objective to provide a means of mounting a cutting bit at a cutting machine that is effectively self-locking and does not require retightening or manual intervention to ensure the cutting bits are secure and that cutting efficiency is not compromised or components of the mounting assembly damaged due to loose or incorrect attachment of the bit within the mount assembly.

The objectives are achieved by providing a retaining or mounting assembly that comprises a locking retainer that is configured to apply and maintain a constant locking force between the cutting bit (or a shaft or adaptor that mounts the cutting bit) and a holder body that couples the bit to the cutting head. The retainer and assembly configuration is advantageous to provide a constant return force to the bit (or the bit shaft/adaptor) to ensure the bit is retained in a fully mated position within its holder and is not loosened due to the cutting vibrations during operation of the machine.

The present disclosure is equally applicable for use with a variety of different types of cutting picks in which a shaft, shank or sleeve that provides a mounting either directly or indirectly for the bit (or bit head) is mounted and retained at a mount body that is attached to the drive or cutting head. The present retainer or mounting assembly therefore is compatible and effective to retain cutting bits at the drive body where the cutting bit is releasably mountable at an adaptor or shank or a bit having a shank that projects rearwardly from the bit head.

According to a first aspect of the present disclosure there is provided a cutting bit retaining assembly for mounting a cutting bit at a cutting machine, the assembly includes a holder body having a through bore extending between a forward and a rearward end of the body; a bit shaft attached or attachable to the bit head, the shaft configured to extend axially through the bore, a rearward region of the shaft configured to project from the rearward end and comprising an abutment portion; and a retainer positionable about the rearward region of the shaft to releasably retain the shaft at the body. The retainer includes a first and a second abutment member spaced apart in the axial direction of the bore and coupled so as to be resilient to axial compression together, wherein the first abutment member contacts the rearward end of the body and the second abutment member contacts the abutment portion of the shaft to provide a retaining force under compression to retain the shaft at the body.

The retainer can have a wedge shaped configuration in that the first and second abutment members are attached at respective first ends such that opposed respective second ends of the abutment members are resistant to compression together. Advantageously, the present retaining assembly and retainer includes a relatively simple construction and is devoid of screw threads or coil spring arrangements that would otherwise provide entrapment zones for dust and other materials common to the environment of mechanical rock excavation and cutting. The present retainer is not therefore susceptible to clogging or accumulation of dirt and dust particles during use and therefore maintains effectiveness within a harsh working environment. Preferably, the retainer has a single unitary body having a bent or folded region such that the first member and the second members project from the bent or folded region at an acute angle relative to one another. The wedged shaped folded plate-like retainer is both convenient to manufacture and install over and about the adaptor of the cutting bit. For example, the retainer may be conveniently anchored at the shaft via a light hammering into position.

The present retainer is advantageous to resist rotation of the shaft or adaptor relative to the holder body. The present configuration provides both axial and radial locking which is effective to extend the operational lifetime of the holder as abrasion/grinding is mitigated.

The first and second members include a respective recess having a size to allow the retainer to be positioned over and about an external surface of the shaft at the rearward region. The first and second abutment members are substantially planar. A size of the recess of the first member is greater than a size of the recess of the second member such that the first member is capable of sliding axially over the shaft to maintain the retaining force. Advantageously, the recess within the second member comprises a shape profile being identical or similar to the circumferential shape profile of the cutting bit shaft to allow the retainer to grip or 'pinch' onto the shaft to be locked in place. Undesirable loss or dislodgement of the retainer is therefore avoided. The relatively enlarged recess within the first member allows the first member to move axially away from the second member to apply the constant retaining force between the cutting bit and the housing body.

Optionally, each of the first and second members have a head portion and a pair of legs extending from each respective head portion being spaced apart to accommodate at least a part of the shaft, the respective legs of the first and second members coupled together such that the respective heads are resistant to compression together in the axial direction of the bit shaft. The legs of the first and second members bend radially inward at the bend or folded region such that the legs wrap circumferentially around the curved outer surface of the cutting bit shaft. That is, the legs are configured to be deflected radially outward as the retainer is hammered into position over the shaft and then to return to their 'neutral' radially inward curved state to enclose around the bit shaft.

The first and second members are formed as a unitary body and the respective legs of the first and second members are coupled together by a bent or folded region. Such a configuration is advantageous to minimise parts of the retainer being weakened due to the cutting vibrations and to avoid accumulation of dirt or dust particles that would interfere with the retaining force at the cutting bit.

Optionally, the first member extends in a first plane and the second member extends in a second plane, the first and second planes projecting at an acute angle relative to one another. The angle defined between the first and second members is optimised to ensure an appropriate retaining force is applied to the cutting bit whilst minimising the space required for the retainer. The present assembly and retainer are therefore compact and lightweight.

Optionally, the abutment region includes a shoulder projecting radially from the shaft. Optionally, the shoulder is defined by a groove indented at the rearward region of the shaft. A circumferentially extending shoulder ensures that a constant locking force is applied and is independent of any rotation of the retainer, the shaft and/or cutting bit about the axis of the bore of the holder body or shaft.

According to further embodiments, the abutment region may include any form of radially extending flange that provides a seat or means of abutting against a part of the retainer to enable the retainer to be braced in position against the holder body.

Optionally, the assembly further includes a detachable bit head releasably mounted at a forward end of the shaft. Such an arrangement is advantageous to allow interchange of bit heads without necessitating replacement of the entire bit shaft. The use of materials is therefore minimised every time a worn or damaged bit requires replacement. Advantageously, the retainer includes a spring steel material. The retainer is therefore configured to be hard wearing within the dust laden environment and can accommodate the significant vibrational forces encountered during cutting operations without being damaged or worn.

According to a second aspect of the present disclosure there is provided a cutting head of a mining machine comprising a plurality of cutting bit retaining assemblies as claimed herein. According to a third aspect of the present disclosure there is provided a cutting machine comprising a plurality of cutting bit retaining assemblies as claimed herein. According to a fourth aspect of the present disclosure there is provided a continuous mining machine having a cutting head comprising a plurality of cutting bit retaining assemblies as claimed herein.

The foregoing summary, as well as the following detailed description of the embodiments, will be better understood when read in conjunction with the appended drawings. It should be understood that the embodiments depicted are not limited to the precise arrangements and instrumentalities shown.

BRIEF DESCRIPTION OF DRAWINGS

A specific implementation of the present disclosure will now be described, by way of example only, and with reference to the accompanying drawings in which:

FIG. 3 is a perspective view of the resiliently compressible retainer of FIG. 1.

FIG. 4 is a perspective view of a rear portion of the holder body, bit shaft and retainer of FIG. 1.

DETAILED DESCRIPTION

The present disclosure is illustrated by way of example and referring to a cutting machine or tool in which a cutting bit is releasably mounted at one end of a shank-like adaptor that is in turn retained at a mount body attached to or protruding from a region of a drive body or cutting head. Reference within the specification to a 'cutting bit shaft' encompass reference to an adaptor, shank or shaft that provides a means of mounting a cutting bit, where the cutting bit refers to the component of the machine or assembly that has a sharpened or otherwise specifically configured end region for contact with the rock or mineral material to be cut or excavated.

Figure 1:
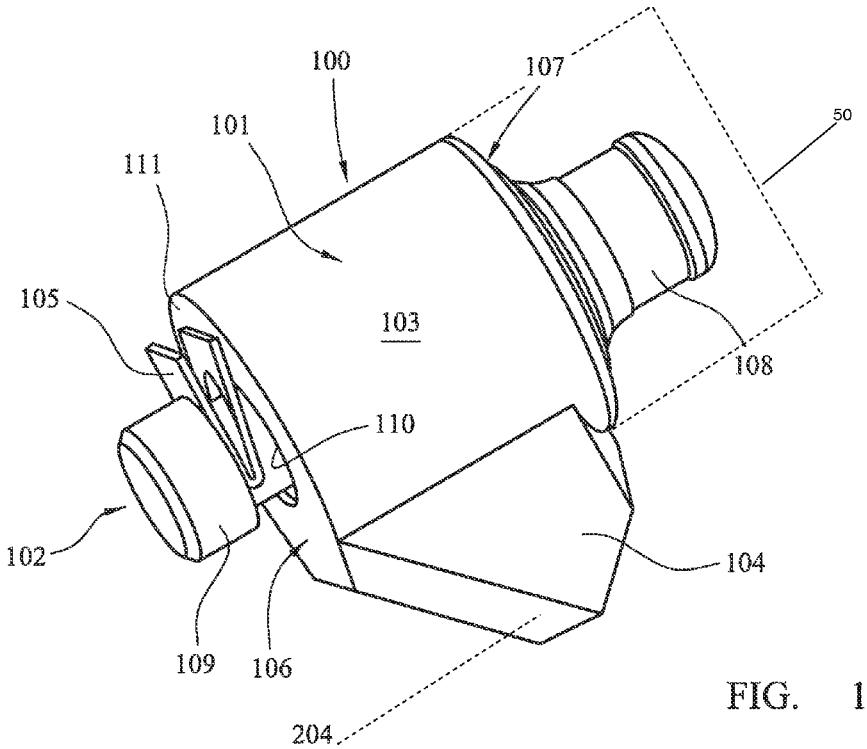
FIG. 1 is a perspective view of cutting bit retaining assembly in which a cutting bit is mounted at a bit shaft and retained at a holder body by a resiliently compressible retainer according to a specific implementation of the present disclosure.

Referring to FIG. 1, a cutting bit assembly 100 is adapted for mounting at an external surface of a drum (not shown) forming a part of a driven rotatable cutting head (not shown) of a continuous mining machine (not shown). The assembly 100 is mounted to the drum via a base mount 104 that projects radially from an external surface 103 of a substantially cylindrical housing body 101. Body 101 includes a forward end 107 and a corresponding rearward end 106. A through bore 110 extends axially through body 101 between the forward and rearward ends 107, 106.

Rearward end 106 is defined by a substantially planar annular face 111 that extends radially between a rearward opening of bore 110 and the body external surface 103. An elongate shaft 102 is mounted within body 101 and in particular shaft 102 extends axially within bore 110 so as to project axially from the forward and rearward ends 107, 106. Shaft 102 is terminated at a forward end by a male projection 108 configured to be received within a female cavity formed within a cutting bit 50 to allow secure and interchangeable mounting of the bit at the shaft 102. That is, when the bit is mounted at shaft 102 it extends from the forward end 107 over and about male projection 108. The bit therefore represents a forwardmost part of assembly 100 during cutting rotation of the cutting head.

A rearwardmost part 109 of shaft 102 is configured to project rearwardly from rearward end 106, face 111 and bore 110. Shaft 102 is retained and anchored at body 101 via a retainer 105 that extends over and about a part of the rearward shaft region 109. In particular, retainer 105 includes a generally wedge-shaped configuration in which a first member is resiliently biased relative to a second member to respectively abut regions of the body 101 and shaft 102 and apply a constant retaining force to urge shaft 102 rearwardly within body 101 and lock securely the bit at the mounting assembly 100.

Figure 2:
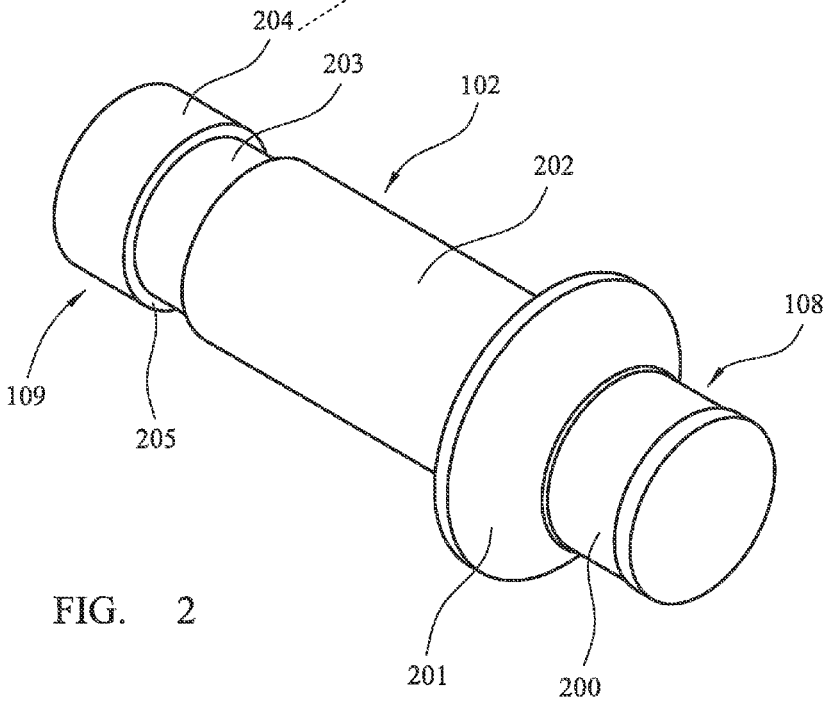
FIG. 2 is a perspective view of the cutting bit shaft of FIG. 1.

Referring to FIG. 2, shaft 102 includes a main shaft length 202 having a substantially uniform radius along its axial length that is approximately equal to the axial length of bore 110. A forward end of main length 202 is terminated by a radially flared flange 201 that is configured to seat against the body forward end 107. Male projection 108 includes a generally cylindrical nose 200 having a radius approximately equal to a radius of the main length 202. As will be appreciated, the shape and configuration of the nose 200 is selectable to suit the shape and configuration of the mating region of the cutting bit 50. The rearward shaft region 109 includes an annular groove 203 that axially terminates main length 202 at the rearward region 109. Groove 203 is terminated at its axially rearward end by a relatively short cylindrical section 204 having a radius corresponding to a radius of main length 202. The junction between groove 203 and section 204 accordingly defines an annular shoulder 205 that is positioned axially rearward from rearward body face 111 when shaft 102 is installed within body 101. Shoulder 205 provides an abutment region to be contacted by a part of retainer 105 whilst another part of retainer 105 is configured to abut rear face 111. Sections 200, 202, 203 and 204 each comprise an external or outer surface having a generally cylindrical shape and configuration.

Referring to FIG. 3, retainer 105 includes a first substantially planar member 301 and a second substantially planar member 300 coupled together via a bent or folded region 306. The first and second members 301, 300 project from bent region 306 at an acute angle relative to one another such that the external shape profile of retainer 105 resembles a wedge-like body. Moreover, retainer 105 is formed as a unitary body that is folded at a mid-region of its main length to define the opposed first and second members 301, 300.

Each of the first and second members 301, 300 includes a respective head portion 303, 302 formed at an opposite end furthest from folded region 306. Each head 303, 302 is defined, in part, by a respective recess 307, 308 that projects along each member 301, 300 from the folded region 306 towards each head 303, 302. In particular, in a pre-folded configuration, recesses 307, 308 are formed as a single oval shaped aperture positioned substantially centrally in a lengthwise direction of retainer 105 and extending substantially a full width of retainer 105. In the folded configuration of FIG. 3, the first and second members 301, 300 may be considered to comprise a pair of spaced apart legs 304, 305 that extend between the folded region 306 and each respective head 303, 302. A shape profile of recess 308, formed within second member 300, defines a segment of a circle being slightly greater than a semi-circle. Recess 307 is more elongate than recess 308 and extends a greater distance from folded region 306 such that a length of the first head 303 is less than a corresponding length of second head 302, in a direction between folded region 306 and head end edges 310. The larger opening defined by recess 307 allows first member 301 to move axially within the groove 203 despite the second member being clamped (or axially locked) around the external surface of groove 203. In particular, an innermost region 309 of recess 307 is maintained at a radially outward position from groove 203 whilst legs 304, 305 grip onto the external facing surface of groove 203. This coupling action is facilitated as the legs 304, 305 taper inwardly in a radial direction (relative to an axis of bore 110 and shaft 102) at the region of the bent portion 306 to effectively 'pinch' onto the groove region 203 of shaft 102.

Referring to FIG. 4, retainer 105 is advantageously mounted at the rearward region of the assembly 100 and is effectively shielded by body 101 during forward drilling rotation. Dust particulate accumulation around the region of retainer 105 is therefore minimised. Additionally, the simple folded construction of retainer 105 ensures the axial locking force is maintained even in the event of particulates accumulating around the rearward regions 106, 109. In the intended configuration, the second member 300 is positioned to abut shoulder 205 and is positioned rearwardmost relative to first member 301 that is intended to abut rearward face 111. Due firstly to the axial separation of shoulder 205 and rear face 111 and secondly the angle of extension of the two members 301, 300 relative to one another, retainer heads 303, 302 are maintained in a state being axially compressed together. In particular, members 301, 300 are locked in a slightly compressed state between section 204 and face 111 such that the respective heads 303, apply a constant axial expansion force between shoulder 205 and face 111. The magnitude of the expansion force may therefore be selectively adjusted during manufacture of retainer 105 by a variation of the angle by which the first and second members 301, 300 project relative to one another from bent region 306. According to the specific implementation, the angle of extension of the first and second members 301, 300 from region 306 is in a range 5 to 40°.

Figure 5:
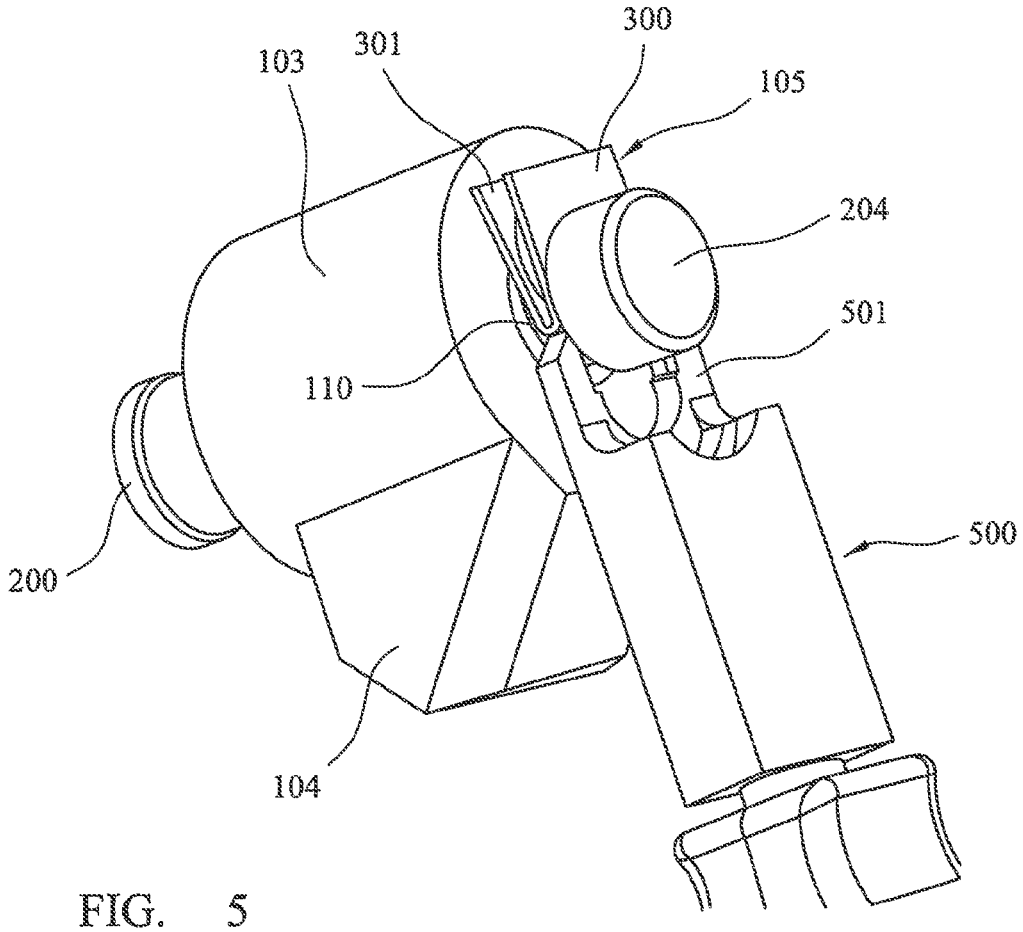
FIG. 5 is a rear perspective view of the retaining assembly of FIG. 1 with a forked tool engaged to dislodge the retainer from positioning about the bit shaft.
Figure 6:
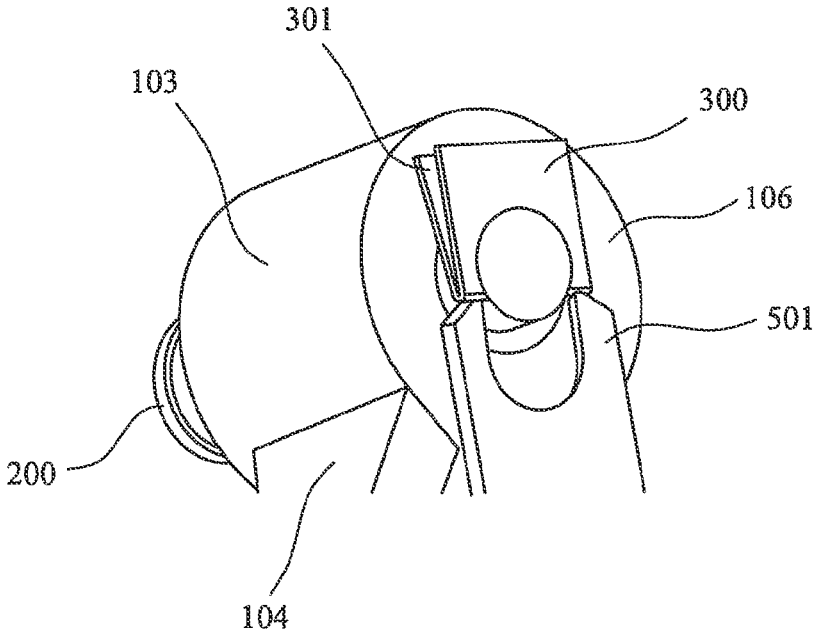
FIG. 6 is a rear perspective view of the assembly of FIG. 5 with a rearward most shoulder part of the shaft removed for illustrative purposes.

Referring to FIGS. 5 and 6, retainer 105 may be installed in position at shaft 102 via personnel using a hammer to force radial separation of legs 304, 305 and allow full mating or seating about the external surface of groove 203 within recess 208. Retainer 105 may be conveniently removed to allow shaft 102 to be withdrawn from body 101 either by applying a pulling or pushing force perpendicular to the axis of shaft 102 and bore 110. In particular, removal may be facilitated by a tool 500 having a dual prong end 501 that engages each side of the fold region 306 using a force sufficient to allow legs 304, 305 to separate radially. With retainer 105 removed, shaft 102 is free to be withdrawn from bore 110 for maintenance or servicing.

As will be appreciated, the shape and configuration of recess 307 is not restricted to an oval or part circular profile and may comprise a rectangular or any other curved or polygonal profile that is 'oversized' relative to the external surface circumferential dimensions of the grooved region 203 to allow some axial movement along the length of shaft 102 to provide the necessary expanding (locking) force. A shape profile of recess 308 preferably matches the external surface shape profile of the region of the grooved region 203 to provide a snug fit and avoid undesirable dislodgement of retainer 105 from about shaft 102.

According to further specific implementations, a 'light' press-fit arrangement is provided at the region of through bore 110 and main shaft length 202 to provide a primary mechanism for retaining shaft 102 at body 101. Retainer 105, in this configuration, provides a secondary retention mechanism and a means of locking redundancy in the event of a temporary break or loss in the press-fit coupling between body 101 and shaft 102 during cutting. Effectively, retainer 105 ensures shaft 102 is retained coupled to body 101 such that the press-fit lock may re-engage with a subsequent cutting pass. The press-fit components within body 101 and at shaft 102 may comprise any conventional arrangements known in the art as will be appreciated.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

The invention claimed is:

1. A cutting bit retaining assembly for mounting a cutting bit at a cutting machine, the assembly comprising:

a holder body having a through bore extending between a forward and a rearward end of the body;

a bit shaft attachable to a cutting bit, the bit shaft extending axially through the bore, a rearward region of the bit shaft projecting from the rearward end and including an abutment portion, wherein the abutment portion is spaced from the rearward end of the body to form a groove therebetween; and a retainer positioned about the rearward region of the shaft to releasably retain the shaft in the body, the retainer having a first and a second abutment member spaced apart in the axial direction of the bore, wherein the first abutment member contacts the rearward end of the body and is axially movable within the groove and the second abutment member is axially locked around an external surface of the groove and contacts the abutment portion of the shaft, each of the first and second members having a head portion and a pair of legs extending from each respective head portion, the legs being spaced apart to accommodate at least a part of the shaft, the respective legs of the first and second members being coupled together such that the respective head portions are resistant to compression together to provide a retaining force under compression to retain the shaft in the body.

2. The assembly as claimed in claim 1, wherein the retainer has a wedge shaped configuration, the first and second abutment members being attached at respective first ends such that opposed respective second ends of the abutment members are resistant to compression together.

3. The assembly as claimed in claim 1, wherein the retainer includes a single unitary body having a bent or folded region such that the first member and the second member project from the bent or folded region at an acute angle relative to one another.

4. The assembly as claimed in claim 3, wherein the first and second members include a respective recess having a size to allow the retainer to be positioned over and about an external surface of the shaft at the rearward region.

5. The assembly as claimed in claim 4, wherein a size of the recess of the first member is greater than a size of the recess of the second member such that the first member is capable of sliding axially over the shaft to maintain the retaining force.

6. The assembly as claimed in claim 3, wherein the first and second abutment members are substantially planar.

7. The assembly as claimed in claim 1, wherein the first and second members are formed as a unitary body and the respective legs of the first and second members are coupled together by a bent or folded region.

8. The assembly as claimed in claim 1, wherein the first member extends in a first plane and the second member extends in a second plane, the first and second planes projecting at an acute angle relative to one another.

9. The assembly as claimed in claim 1, wherein the abutment region includes a shoulder projecting radially from the shaft.

10. The assembly as claimed in claim 1, wherein the retainer comprises a spring steel material.

11. A cutting head of a mining machine comprising a plurality of cutting bit retaining assemblies, each of the plurality of cutting assemblies comprising:

a holder body having a through bore extending between a forward and a rearward end of the body;

a bit shaft attachable to a cutting bit, the shaft extending axially through the bore, a rearward region of the bit shaft projecting from the rearward end and including an abutment portion, wherein the abutment portion is spaced from the rearward end of the body to form a groove therebetween; and a retainer positioned within the groove about the rearward region of the shaft to releasably retain the bit shaft in the body, the retainer having a first and a second abutment member spaced apart in the axial direction of the bore and coupled so as to be resilient to axial compression together, wherein the first abutment member contacts the rearward end of the body and is axially movable within the groove and the second abutment member is axially locked around an external surface of the groove and contacts the abutment portion of the shaft to provide a retaining force under compression to urge the shaft rearwardly within body and retain the shaft in the body.

12. A cutting machine comprising a plurality of cutting bit retaining assemblies, each of the plurality of cutting bit retaining assemblies comprising:

a holder body having a through bore extending between a forward and a rearward end of the body;

a bit shaft attachable to a cutting bit, the shaft extending axially through the bore, a rearward region of the bit shaft projecting from the rearward end and including an abutment portion, wherein the abutment portion is spaced from the rearward end of the body to form a groove therebetween; and a retainer positioned within the groove about the rearward region of the shaft to releasably retain the bit shaft in the body, the retainer having a first and a second abutment member spaced apart in the axial direction of the bore and coupled so as to be resilient to axial compression together, wherein the first abutment member contacts the rearward end of the body and is axially movable within the groove and the second abutment member is axially locked around an external surface of the groove and contacts the abutment portion of the shaft to provide a retaining force under compression to urge the shaft rearwardly within body and retain the shaft in the body.

13. A continuous mining machine having a cutting head comprising a plurality of cutting bit retaining assemblies, each of the plurality of cutting bit retaining assemblies comprising:

a holder body having a through bore extending between a forward and a rearward end of the body;

a bit shaft attachable to a cutting bit, the shaft extending axially through the bore, a rearward region of the bit shaft projecting from the rearward end and including an abutment portion, wherein the abutment portion is spaced from the rearward end of the body to form a groove therebetween; and a retainer positioned within the groove about the rearward region of the shaft to releasably retain the bit shaft in the body, the retainer having a first and a second abutment member spaced apart in the axial direction of the bore and coupled so as to be resilient to axial compression together, wherein the first abutment member contacts the rearward end of the body and is axially movable within the groove and the second abutment member is axially locked around an external surface of the groove and contacts the abutment portion of the shaft to provide a retaining force under compression to urge the shaft rearwardly within body and retain the shaft in the body.

* * * * *